US008669911B2

(12) United States Patent
Sergi et al.

(10) Patent No.: US 8,669,911 B2
(45) Date of Patent: Mar. 11, 2014

(54) BALANCED TRANSMISSION LINE WITH PARALLEL CONDUCTORS

(75) Inventors: Paul D. Sergi, Peninsula, OH (US); Charles T. Rauch, Barnesville, GA (US)

(73) Assignee: PDS Electronics, Inc., Tallmadge, OH (US)

( * ) Notice: Subject to any disclaimer, the term of this patent is extended or adjusted under 35 U.S.C. 154(b) by 471 days.

(21) Appl. No.: 13/065,814

(22) Filed: Mar. 30, 2011

(65) Prior Publication Data

US 2011/0260812 A1 Oct. 27, 2011

Related U.S. Application Data

(60) Provisional application No. 61/343,218, filed on Apr. 26, 2010.

(51) Int. Cl.
*H01Q 9/28* (2006.01)

(52) U.S. Cl.
USPC ..... 343/795; 343/853

(58) Field of Classification Search
USPC ..... 343/795, 853
See application file for complete search history.

(56) References Cited

U.S. PATENT DOCUMENTS

| | | | | |
|---|---|---|---|---|
| 3,005,986 | A | 10/1961 | Reed | |
| 3,750,185 | A | 7/1973 | Evans | |
| 4,071,846 | A | 1/1978 | Oltman, Jr. | |
| 4,204,213 | A | 5/1980 | Wheeler et al. | |
| 6,037,911 | A | 3/2000 | Brankovic et al. | |
| 2002/0190912 | A1 * | 12/2002 | Lebaric et al. | 343/795 |

FOREIGN PATENT DOCUMENTS

| | | |
|---|---|---|
| EP | 1 229 605 A1 | 7/2002 |
| GB | 0655803 | 8/1951 |
| GB | 1343 498 | 1/1974 |
| GB | 2464582 A | 4/2010 |

OTHER PUBLICATIONS

UK Combined Search and Examination Report of Application No. GB1107049.7 (7 pages—dated Jul. 28, 2011).

* cited by examiner

*Primary Examiner* — Kristy A Haupt
(74) *Attorney, Agent, or Firm* — Renner, Kenner, Greive, Bobak, Taylor & Weber

(57) ABSTRACT

An antenna transmission line for feeding multiple items includes a first conductor member, a second conductor member, and a dielectric material positioned between the first and second conductor members, which prevents water from accumulating between the first and second conductive members. Means are provided to connect multiple elements to the transmission line at connection terminals. An insulator may be provided adjacent to each of the connection terminals, the insulator being generally non-conductive. A plurality of holes provided in the insulator on either side of the conductor members allows the elements to be weaved therethrough to provide a more stable connection.

18 Claims, 6 Drawing Sheets

BALANCED TRANSMISSION LINE WITH PARALLEL CONDUCTORS

This application claims priority from U.S. Provisional Application Ser. No. 61/343,218 filed Apr. 26, 2010, which is incorporated herein in its entirety.

TECHNICAL FIELD

This invention relates to a transmission line feed and mounting system for an antenna. More particularly, this invention relates to a balanced transmission line feed and mounting system having parallel conductors and adapted to be used with a Hex-beam antenna.

BACKGROUND ART

Amateur radio antennas, such as those known in the art as Hex-beam antennas (sold by Traffie Technology of Ashby, Mass., and others), include a complex transmission line system to deliver RF power to driven elements of the antenna. The transmission line system is mounted to a mast of the antenna and is centrally located among a plurality of spreader arms extending outwardly from the mast. These antennas are popular due to their low cost and relative ease of installation. However, they are not without their problems.

Conventional transmission line feed systems are made of multiple lengths of coaxial cable arranged in series, with feed points of the antenna's driven elements attached to the junctions between the various lengths of coaxial cable. Such a transmission line system is difficult to manufacture for a variety of reasons. The multiple lengths of coaxial lines must be provided in various specific lengths, and require numerous points of connection to be manually prepared and soldered, which is a labor intensive and time consuming task. In addition, each of the multiple lengths of coaxial cable must be sealed to prevent water infiltration. Moreover, a coaxial transmission line is non-balanced, whereas the driven elements of the antenna are balanced, thereby necessitating a balun at each feed point for more optimum performance. Furthermore, each of the driven elements pulls on the terminals of the coaxial feed line, thereby requiring a separate mechanical arrangement to absorb tension in the driven elements.

Thus, the need exists for a transmission line system that is easier to manufacture, more stable and reliable, and that is electrically balanced so that no balun is needed at each element to transmission line junction.

DISCLOSURE OF THE INVENTION

It is thus an object of one aspect of the present invention to provide a transmission line that is electrically balanced.

It is an object of another aspect of the present invention to provide a transmission line, as above, that is more stable and reliable, so that less stress is applied by elements connected at the terminals.

It is an object of another aspect of the present invention to provide a transmission line, as above, that is easy to manufacture and does not require manual preparation and soldering of a high number of connection points.

It is an object of another aspect of the present invention to provide a transmission line, as above, that is impervious to water collecting between the conductors.

These and other objects of the present invention, as well as the advantages thereof over existing prior art forms, which will become apparent from the description to follow, are accomplished by the improvements hereinafter described and claimed.

In general, a transmission line according to the concepts of the present invention includes a first conductor member, a second conductor member, and a dielectric member positioned between the first and second conductor members. Means are provided for connecting multiple elements of the antenna to the conductor members.

In accordance with another aspect of the present invention, a transmission line includes a first conductor member, a second conductor member, and a dielectric member positioned between the first and second conductor members. A plurality of insulators are positioned adjacent to and oriented generally perpendicular to the first conductor member, and a plurality of connection terminals are provided for connecting multiple items to the conductor members. The insulators are substantially non-conductive and include a plurality of apertures on each side of the first conductor member.

A preferred exemplary transmission line according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
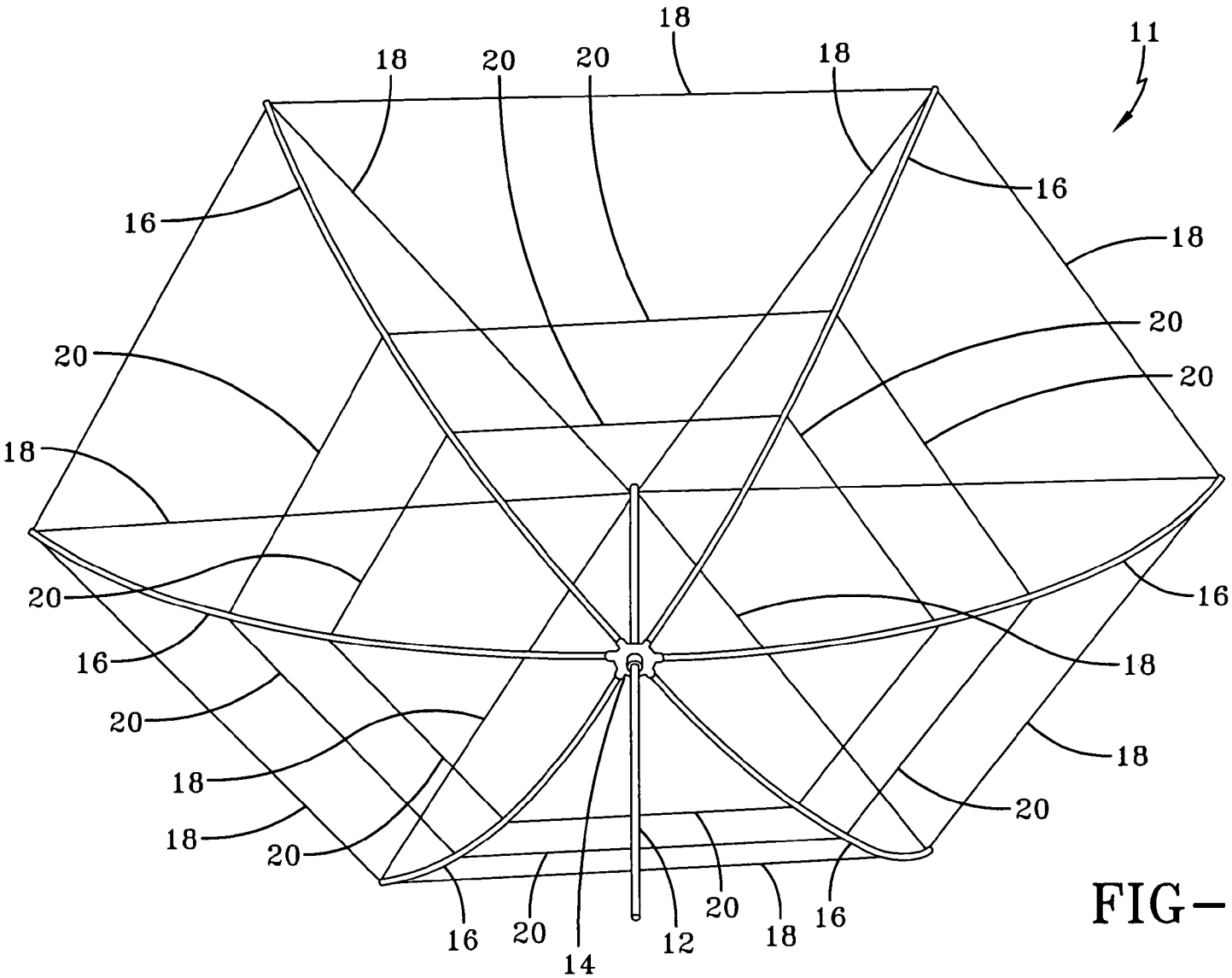
FIG. 1 is a perspective view of an antenna having a parallel conductor transmission line made in accordance with the present invention.
Figure 2:
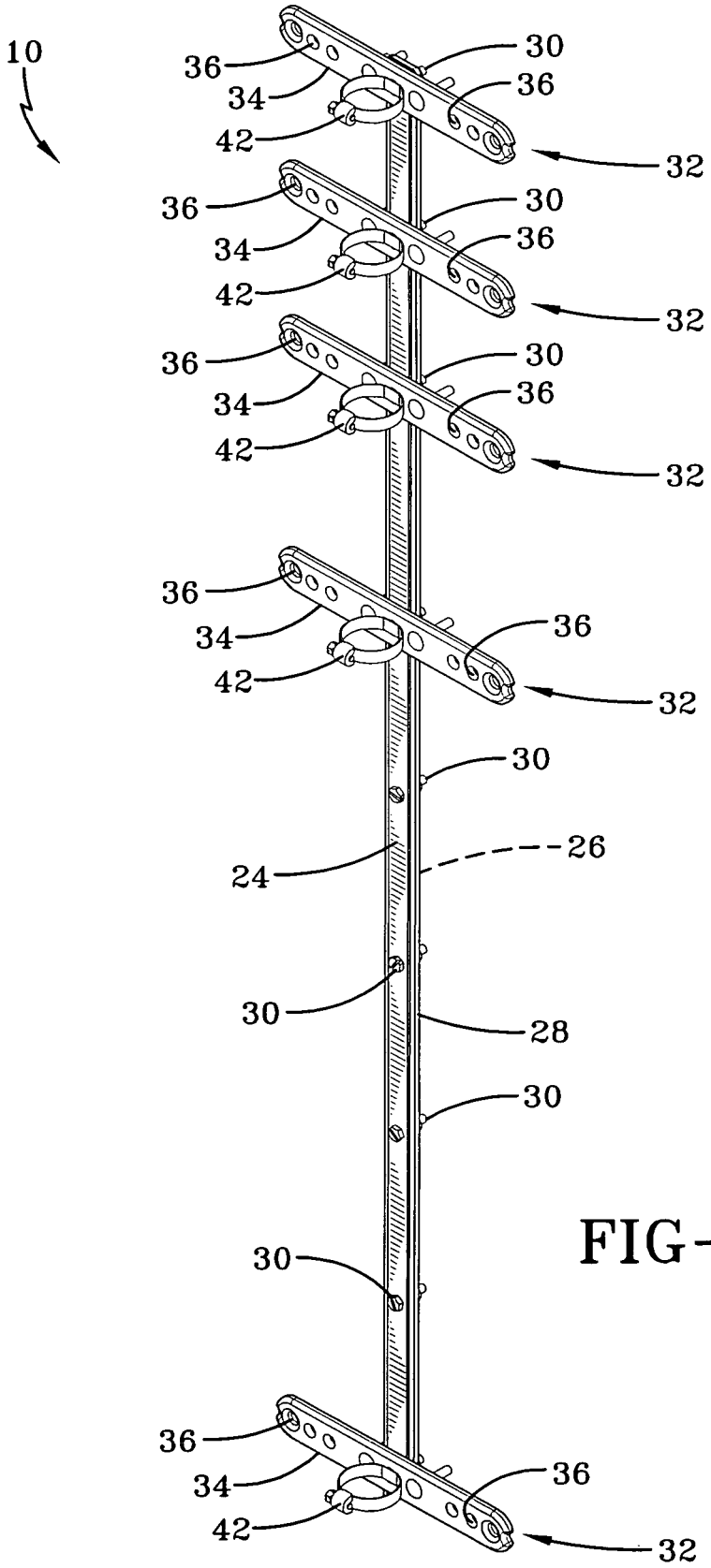
FIG. 2 is a perspective view of the parallel conductor transmission line.
Figure 3:
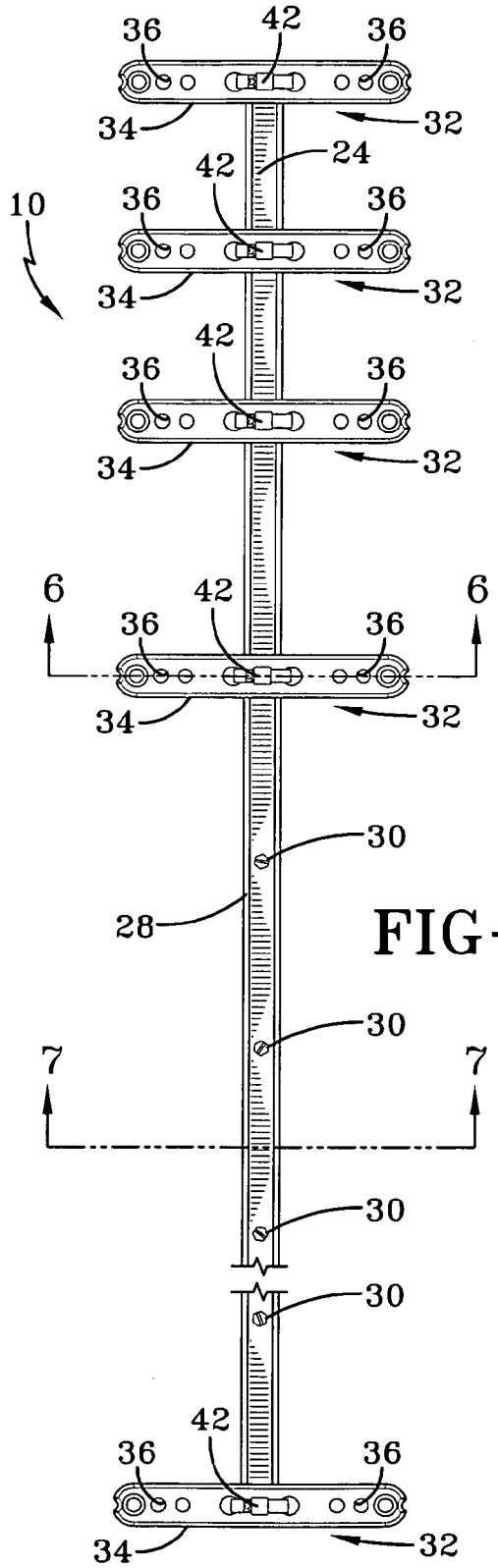
FIG. 3 is a front elevational view of the parallel conductor transmission line.
Figure 4:
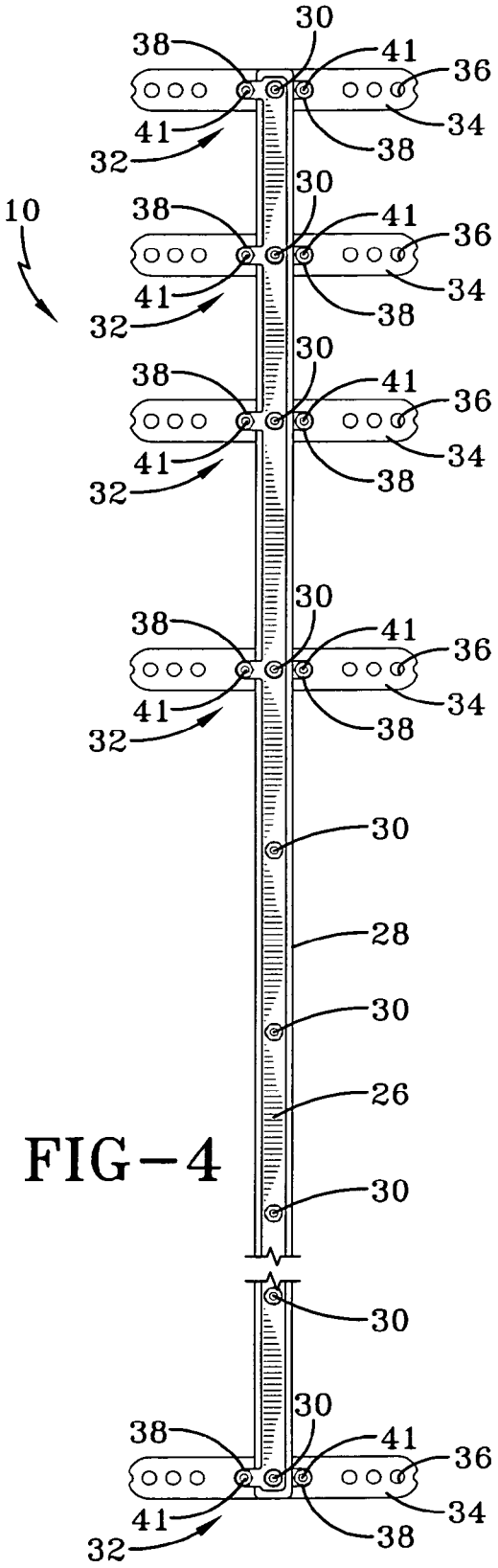
FIG. 4 is a rear elevational view of the parallel conductor transmission line.
Figure 5:
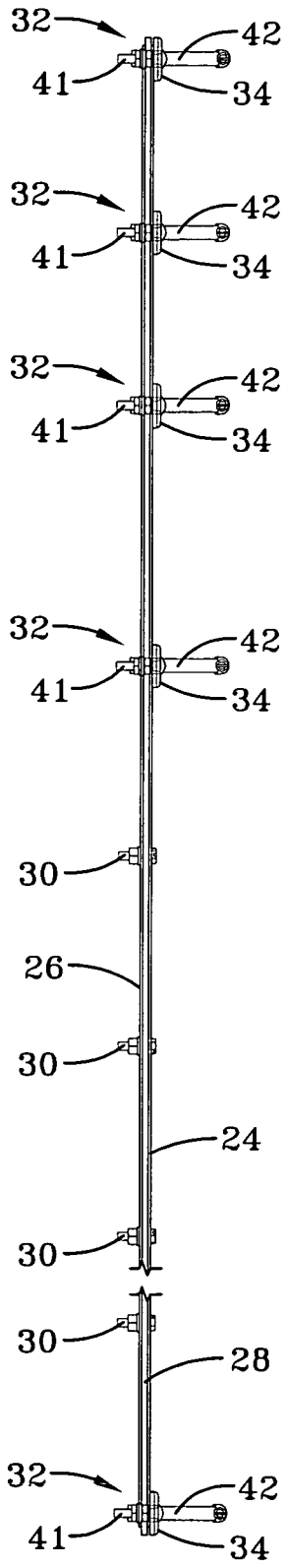
FIG. 5 is a right side elevational view of the parallel conductor transmission line.
Figure 6:
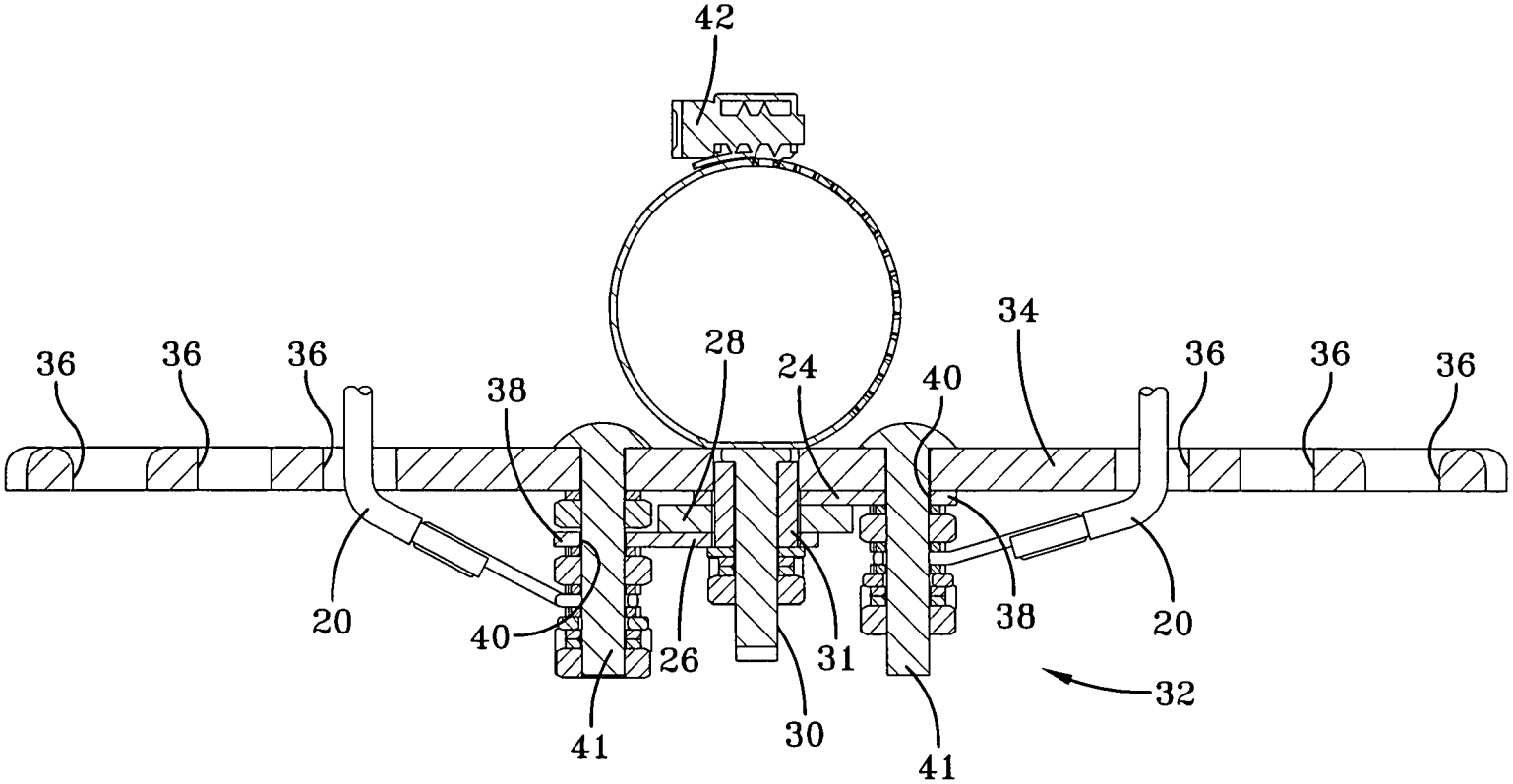
FIG. 6 is an enlarged sectional view taken substantially along line 6-6 of FIG. 3.
Figure 7:
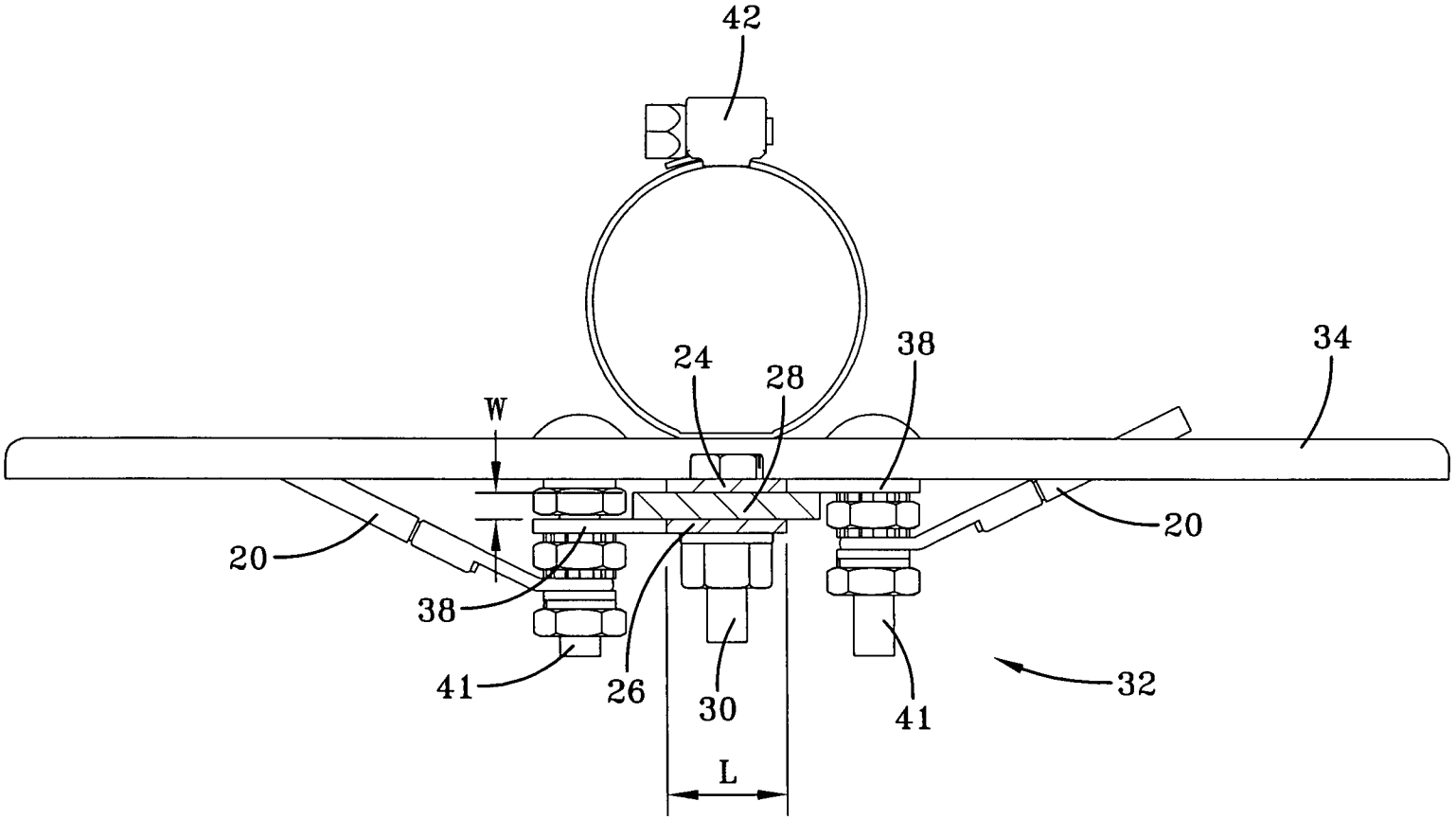
FIG. 7 is an enlarged sectional view taken substantially along line 7-7 of FIG. 3.

A parallel conductor transmission line made in accordance with the present invention is indicated generally by the numeral 10 and is adapted to be used in an antenna generally indicated by the numeral 11 and schematically shown in FIG. 1. Antenna 11 includes a mast 12 that may be positioned near the ground or may be supported substantially above the ground by a post or tower (not shown). A plate or hub 14 is attached to mast 12 and carries a plurality of spreaders 16 which are tubular in nature. In certain embodiments, spreaders 16 may be made of fiberglass. Ropes 18 are typically used to apply tension between spreaders, and thus spreaders 16 are bent as shown in FIG. 1. Antenna 11 thus takes on the shape of an inverted umbrella. A plurality of antenna wires or elements 20 are carried between spreaders 16 and thus generally take on a hexagonal shape. Transmission line 10 (FIGS. 2-8) may be mounted to or around mast 12 and above plate 14, as will be discussed hereinafter in more detail.

The parallel conductor transmission line 10 includes a first conductor member 24 and a second conductor member 26. The term conductor as used herein refers to the ability to carry an electric current. It will be appreciated by those skilled in the art that some materials may be better suited to act as a conductor then other materials, however, the scope of the present invention should not be limited to only those materials known to have extremely high conductivity. As an example, first and second conductor members 24 and 26 may be made of stainless steel or other metals. While conductors in the form of plates are described herein and shown in the accompanying drawings, it is also contemplated that the transmission line may be adapted to incorporate conductor members in other forms, such as those having a rounded or irregular sectional profile.

A dielectric member 28 is positioned between first and second conductor members 24 and 26. The conductor members 24 and 26 are completely separated and isolated from one another by dielectric member 28. The dielectric member 28 is an insulator having a low degree of electric conductivity, and may be made of any material known to those skilled in the art as having electrically insulating characteristics. Such may include, for example, polytetrafluoroethlyene (PTFE) fluoropolymer. PTFE is commercially available under the trade name Teflon® (manufactured by DuPont™). Dielectric member 28, when assembled between conductor members 24 and 26, creates a transmission line that is impervious to water. In other words, water is prevented from accumulating between the conductor members 24 and 26, which would alter the impedance of the transmission line and could create other problems in freezing temperatures.

The dielectric material constant of the dielectric material used will impact the size and spacing of first and second conductor members 24 and 26, as discussed below. In many instances, transmission line 10 must be designed to have a specific Characteristic Impedance. The Characteristic Impedance of the transmission line having parallel conductor members in the form of plates, as shown in the drawings, is represented by the following formula:

$$Z_0 = 377\left[\frac{w}{L}\right]\left[\frac{1}{\varepsilon}\right]^{1/2}$$

The applicant has determined that the Characteristic Impedance $Z_0$ of a parallel conductor transmission line is a function of the width L (see FIG. 7) of the first and second conductor plates and the distance of separation w between the conductor plates, as well as the dielectric material constant $\in$. The width L of the conductor plates 24 and 26 is the transverse distance across the plate perpendicular to the longitudinal dimension of the conductor plates. The space between the conductor plates w is the distance between the adjacent planar surfaces of the conductor plates, which is equal to the thickness of the dielectric member there between. Thus, if the transmission line 10 is to be used in place of a conventional transmission line having a characteristic impedance of 50 ohms, and the dielectric constant $\in$ of the dielectric member is known, the width of the first and second conductor plates 24 and 26 and the space between the conductor plates can be determined using the above formula.

First conductor member 24, second conductor member 26 and dielectric member 28 are secured together by a plurality of fasteners 30. Fasteners 30 are spaced along the longitudinal length of transmission line 10, and extend through holes in each of the first and second conductor members 24 and 26 and the dielectric member 28. Fasteners 30 may be any type or style of fastener known to those skilled in the art. For example, fasteners 30 may be made of polymer or other non-conductive materials. Alternatively, fasteners 30 may be conductive bolts having a non-conductive bushing 31 surrounding the portion of the bolt positioned in the holes to prevent shorting of the transmission line.

A plurality of element connection terminals 32 are provided along the length of transmission line 10. Each of the element connecting terminals 32 is substantially identical, and therefore a single terminal will be described. Each terminal 32 includes an insulator 34 positioned adjacent to first conductor member 24 and oriented generally perpendicular thereto. Insulator 34 is non-conductive, and therefore does not affect the electric charge traveling across first conductor member 24. Insulator 34 is shaped according to the intended usage and design considerations, and may be generally rectangular in shape as shown in the drawings. Insulator 34 includes a plurality of apertures 36 on each side of first conductor member 24.

Each terminal 32 may also include tabs 38 (FIG. 4) extending from first and second conductor members 24 and 26. A tab 38 extending from first conductor member 24 extends in a first direction generally parallel to insulator 34. A tab 38 extending from second conductor member 26 extends in a second direction generally parallel to insulator 34. Each tab 38 includes a hole 40 therethrough. A bolt 41 is received in each hole 40 of tabs 38 and passes through an aperture 36 in insulator 34. In this way, insulator 34 is secured to conductor members 24 and 26. Elements 20 of antenna 11 may be weaved through apertures 36 of insulator 34, and the ends thereof may be connected to conductor members 24 and 26 at tabs 38. In certain embodiments, elements 20 may be received around bolts 41 to secure the elements to the tabs. Weaving elements 20 through apertures 36 allows insulator 34 to absorb tension and pressure from the elements to prevent those forces from acting upon the connection of elements 20 at tabs 38.

A plurality of clamps 42 are provided along the length of transmission line 10. Clamps 42 are adapted to secure transmission line 10 to mast 12 of antenna 11. Clamps 42 may be provided in any known form or configuration, and may preferably be secured to insulators 34 to prevent shorting.

As will be appreciated by those skilled in the art, a transmission line made in accordance with the teachings herein is balanced and provides stable and reliable support for the elements of an antenna. The transmission line is also easy to manufacture as compared to known techniques because the necessity of manually preparing and soldering numerous connection points is eliminated from the process. It is thus evident that a transmission line constructed as described herein accomplishes the objects of the present invention and otherwise substantially improves the art.

What is claimed is:

1. A transmission line for feeding multiple items comprising a first conductor member, a second conductor member, a dielectric member between said first and second conductor members, and means for connecting multiple elements to said conductor members, said dielectric member including polytetrafluoroethylene fluoropolymer.

2. The transmission line of claim 1, wherein said first and second conductor members are made of a rigid conductive material.

3. The transmission line of claim 1, wherein said first and second conductor members and said dielectric member are secured together by a plurality of fasteners.

4. The transmission line of claim 3, wherein said fasteners are made of substantially non-conductive materials.

5. The transmission line of claim 3, wherein said fasteners are made of metal, and a substantially non-conductive bushing surrounds said fasteners.

6. The transmission line of claim 1, wherein said means for connecting multiple elements includes at least one insulator positioned adjacent and oriented generally perpendicular to said first conductor member.

7. The transmission line of claim 6, wherein said insulator is substantially non-conductive.

8. The transmission line of claim 1, further comprising at least one mounting mechanism adapted to secure the transmission line to a support structure.

9. A transmission line for feeding multiple items comprising a first conductor member, a second conductor member, a dielectric member between said first and second conductor members, and means for connecting multiple elements to said conductor members, said means for connecting multiple elements including at least one insulator positioned adjacent to, and oriented generally perpendicular to, said first conductor member, said insulator including a plurality of apertures on each side of said first conductor member.

10. A transmission line for feeding multiple items comprising a first conductor member, a second conductor member, a dielectric member between said first and second conductor members, and means for connecting multiple elements to said conductor members, said means for connecting multiple elements including a plurality of insulators spaced along said first conductor member and positioned adjacent to, and oriented generally perpendicular to, said first conductor member.

11. The transmission line of claim 10, wherein said means for connecting multiple elements includes a tab extending in a first direction from said first conductor member adjacent to each insulator, and a tab extending in a second direction from said second conductor member adjacent to each insulator.

12. The transmission line of claim 11, wherein said means for connecting multiple elements further includes a fastener received through a hole in said tab of one of said first and second conductor members and one of said insulators.

13. The transmission line of claim 11, wherein elements of an antenna are connected to one of said first and second conductor members at said tabs.

14. The transmission line of claim 13, wherein said insulator includes a plurality of apertures, said elements being weaved through said apertures so that said insulator absorbs tension in the elements.

15. A transmission line comprising a first conductor member, a second conductor member, a dielectric member between said first and second members, a plurality of insulators positioned adjacent to and oriented generally perpendicular to said first conductor member, and a plurality of connection terminals for connecting multiple items to said conductor members, wherein each of said insulators is substantially non-conductive and includes a plurality of apertures on each side of said first conductor member, said connection terminals each including a tab extending in a first direction from said first conductor member adjacent to each insulator, and a tab extending in a second direction from said second conductor member adjacent to each insulator.

16. The transmission line of claim 15, wherein said first and second conductor members and said dielectric member are secured together by a plurality of fasteners.

17. The transmission line of claim 15, wherein said connection terminals further include a fastener received through a hole extending through said tab of one of said first and second conductor members and one of said insulators.

18. The transmission line of claim 15, wherein elements of an antenna are connected to said first and second conductor members at said tabs.

* * * * *